United States Patent [19]

Kobayashi

[11] Patent Number: 5,067,918

[45] Date of Patent: Nov. 26, 1991

[54] REVERSE THRUSTER FOR WATER JET PROPULSION

[75] Inventor: Noboru Kobayashi, Iwata, Japan

[73] Assignee: Yamaha Hatsudoki Kabushiki Kaisha, Iwata, Japan

[21] Appl. No.: 452,699

[22] Filed: Dec. 18, 1989

[30] Foreign Application Priority Data

Dec. 19, 1988 [JP] Japan ..... 63-321594

[51] Int. Cl.[5] ..... B63H 11/10

[52] U.S. Cl. ..... 440/39; 114/270; 440/40; 440/41

[58] Field of Search ..... 440/41, 39, 40; 441/71; 114/220

[56] References Cited

U.S. PATENT DOCUMENTS

| | | | |
|---|---|---|---|
| 2,704,043 | 3/1955 | Drier . | |
| 3,020,568 | 2/1962 | Tierney . | |
| 3,052,899 | 9/1962 | Antoine . | |
| 3,077,616 | 2/1963 | Billingham . | |
| 3,229,312 | 1/1966 | Smith . | |
| 3,426,724 | 2/1969 | Jacobson | 114/270 |
| 3,623,447 | 11/1971 | Jacobson . | |
| 3,685,068 | 8/1972 | Reed . | |
| 3,826,220 | 7/1974 | Jacobson . | |
| 3,982,497 | 9/1976 | Caron | 114/270 |
| 4,598,661 | 7/1986 | Roe . | |
| 4,599,965 | 7/1986 | Johnson . | |
| 4,628,852 | 12/1986 | Nishida . | |
| 4,635,580 | 1/1987 | Nishida . | |
| 4,681,058 | 7/1987 | Nishida . | |
| 4,699,596 | 10/1987 | Klinker et al. | 441/71 |
| 4,832,632 | 5/1989 | Rogozienski | 440/39 |
| 4,850,908 | 7/1989 | Nakase et al. | 440/39 |

FOREIGN PATENT DOCUMENTS

| | | | |
|---|---|---|---|
| 166693 | 7/1988 | Japan | 440/39 |

*Primary Examiner*—Sherman Basinger
*Assistant Examiner*—Thomas J. Brahan
*Attorney, Agent, or Firm*—Ernest A. Beutler

[57] ABSTRACT

A small watercraft having a jet propulsion unit with a flow directing device for creating a rooster tail spray and a reverse thrust bucket that is formed with clearances so as not to interfere with the spray when operating in the forward direction and to permit the reverse thrust bucket to move to its reverse position without interference from the flow directing device.

9 Claims, 4 Drawing Sheets

REVERSE THRUSTER FOR WATER JET PROPULSION

BACKGROUND OF THE INVENTION

This invention relates to a reverse thruster for a water jet propulsion unit and more particularly to an improved reverse thruster and signaling arrangement for small watercraft powered by jet propulsion units.

An increasingly popular type of small watercraft is that which is designed to be operated primarily by a single rider and which is propelled by a jet propulsion unit. Such watercraft offer greatly enhanced sporting characteristics and high utility. However, because of their small size, this type of watercraft may not be easily visible from larger watercraft. Also, because of the use of the jet propulsion unit, this type of watercraft does not provide the water spray of conventional powered watercraft that can be visible from great distances. It has, therefore, been proposed to provide a water jet signaling-device as shown in the copending application entitled "Signal Device For Small Boat", Ser. No. 922,280, filed Oct. 23, 1986 in the name of Noboru Kobayashi so as to provide a signal that will enable the spotting of this type of watercraft from considerable distances.

In conjunction with such small watercraft, however, there are many instances when it is desirable to be able to propel the watercraft in a rearward direction as well as in a forward direction. In certain of the embodiments shown in the aforenoted positioned in the discharge nozzle of the jet propulsion unit. As a result, the device is positioned so that it could interfere with the operation of a conventional reverse type bucket.

It is, therefore, a principal object of this invention to provide an improved reverse thruster for a water jet propulsion unit wherein a signaling device can be employed and which will not interfere with the operation of the reverse bucket.

It is a further object of this invention to provide a combined reverse thruster and signaling device for a small jet propulsion unit wherein each device will be able to operate without interference from the other.

The aforenoted type of signaling device is highly effective. However, conventionally, it has been the practice to position the flow deflecting device so that it is positioned at the upper extremity of the jet propulsion discharge nozzle. As a result, the water flow may not be as great as desired to provide the necessary spray deflection. It is, therefore, a still further object of this invention to provide an improved signaling device for a small watercraft that will provide a significant spray even when travelling at low speeds.

SUMMARY OF THE INVENTION

A first feature of this invention is adapted to be embodied in a jet propulsion unit for a small watercraft that has a discharge nozzle. A flow deflecting device is positioned in the discharge nozzle for deflecting a portion of the water flowing through the discharge nozzle in a generally upward direction to form a rooster tail effect. A reverse bucket is supported for movement from a retracted, forward position to an obstructed, reverse position wherein the jet propulsion unit effects a reverse thrust. A reverse thrust bucket is being formed with a clearance portion to clear the flow deflecting device when the reverse thrust bucket is in at least one of its positions.

Another feature of this invention is adapted to be embodied in a jet propulsion unit and flow deflecting device which is positioned in the discharge nozzle of the jet propulsion unit for deflecting a portion of the water flowing through the discharge nozzle in a generally upward direction to form a rooster tail effect. In accordance with this feature of the invention, the inlet for the flow deflecting device is positioned at a substantial distance below the upper periphery of the discharge nozzle of the jet propulsion unit so as to receive a substantially unrestricted and high volume of water flow for deflection.

DETAILED PREFERRED EMBODIMENTS OF THE INVENTION

Figure 1:
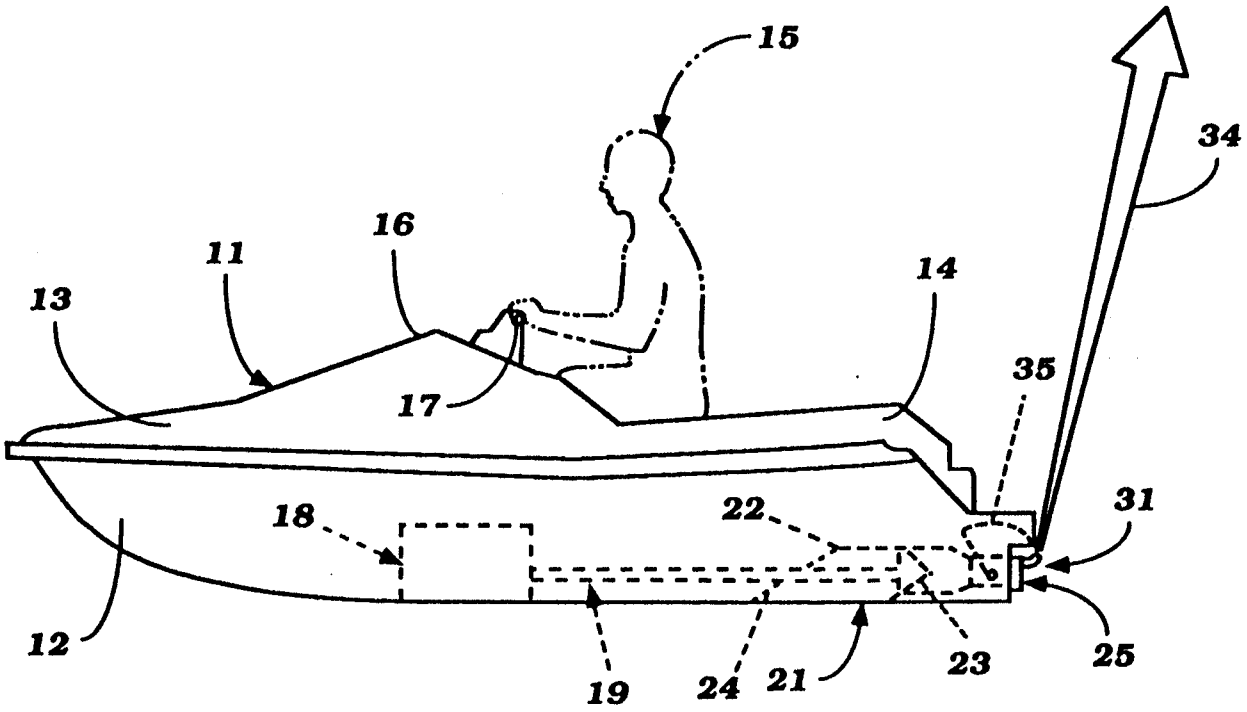
FIG. 1 is a side elevational view of a small watercraft constructed in accordance with an embodiment of the invention.

Referring first to FIG. 1, a small watercraft constructed in accordance with an embodiment of the invention as identified generally by the reference numeral 11. The small watercraft 11 is comprised of a hull consisting of a lower hull portion 12 and an upper deck portion 13 which are connected to each other in an appropriate manner and which may be formed from a molded fiberglass reinforced resin. A seat 14 is formed at the rear of the deck portion 13 and is adapted to accommodate a single rider 15 seated thereon in straddle fashion. A raised bridge portion 16 is positioned forwardly of the seat 14 and contains a handlebar assembly 17 for steering of the watercraft in a manner to be described.

An engine compartment is formed within the hull beneath the deck 16 and contains an internal combustion engine, shown schematically at 18 and which may be of any known type. The engine 18 drives a drive shaft 19 for a jet propulsion unit, indicated generally by the reference numeral 21. The jet propulsion unit 21 is comprised of an outer housing 22 that is mounted within a tunnel formed centrally of the rear portion of the hull 21 and in which an impeller 23 is rotatably journaled. The impeller 23 is connected for rotation with the drive shaft 19 and draws water through a water inlet 24 and discharges it through a steering discharge nozzle 25.

Figure 2:
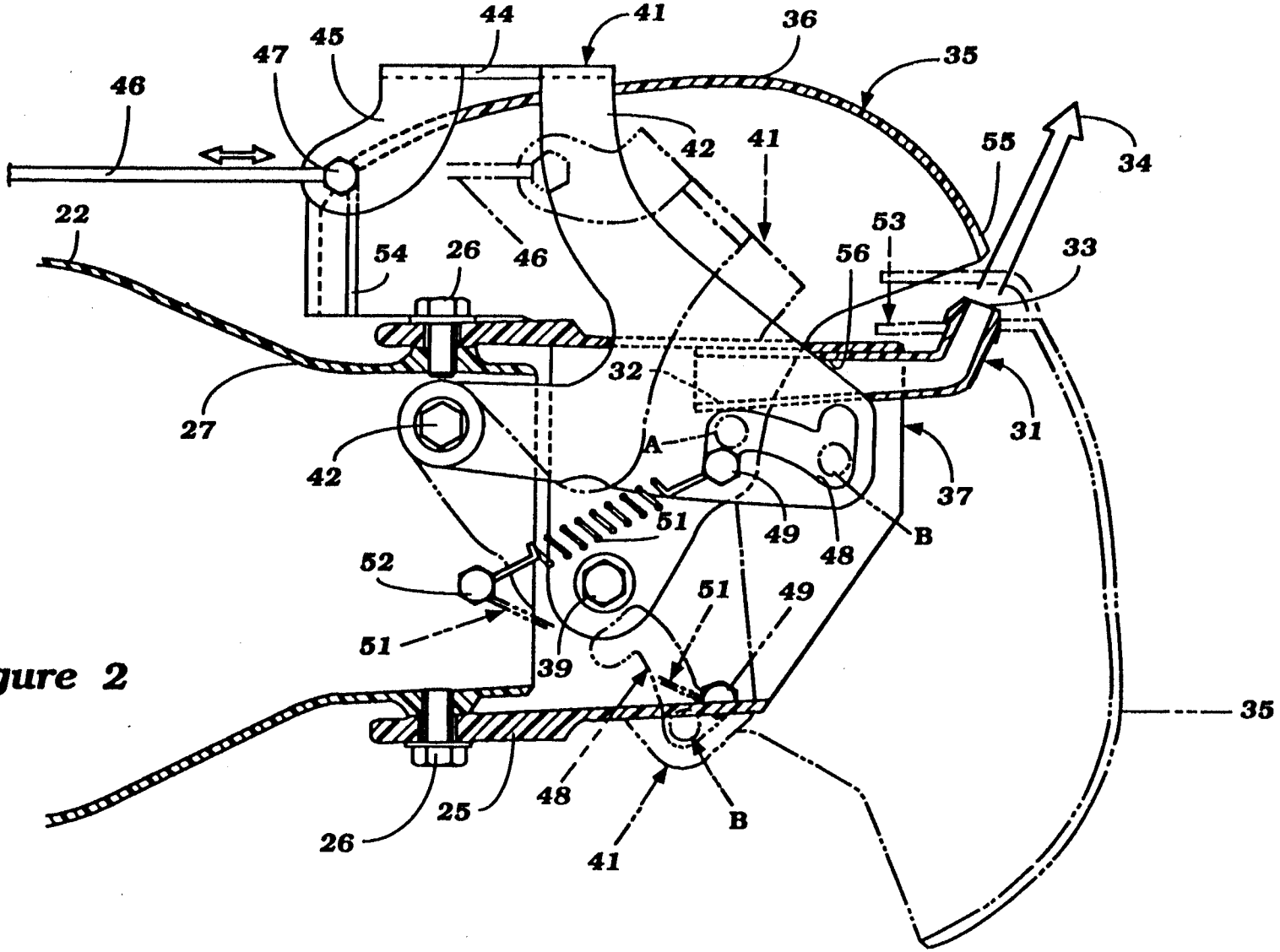
FIG. 2 is an enlarged cross-sectional view taken through the discharge nozzle of the jet propulsion unit and shows the reverse thruster in a forward position in solid lines and in a reverse position in phantom lines.
Figure 3:
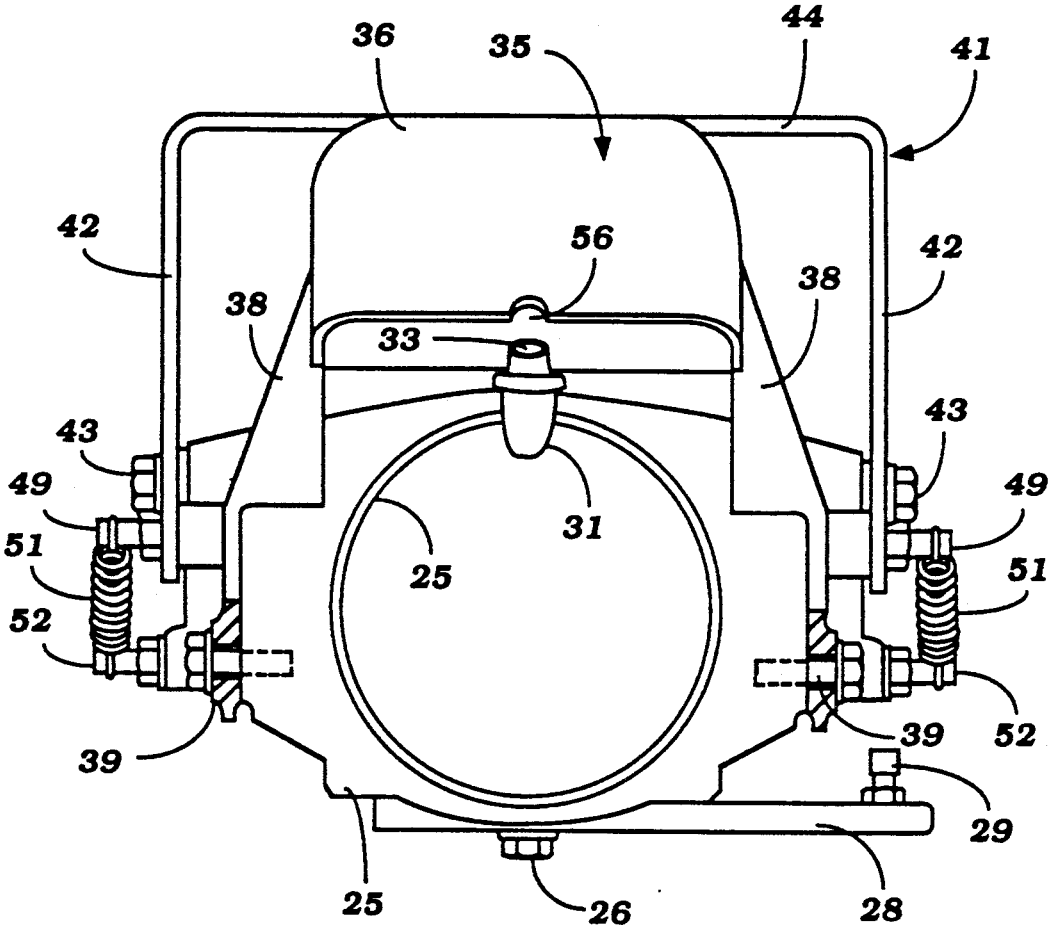
FIG. 3 is a rear elevational view of the jet propulsion unit.

Referring now to FIGS. 2 and 3, it will be seen that the steering nozzle 25 is pivotally supported by means of a pair of vertically extending pivot pins 26 adjacent a discharge nozzle section 27 of the main jet propulsion unit housing 22. A steering lever arm assembly 28 is affixed to the steering nozzle 25 and has a connection 29 to a linkage system (not shown) that is coupled to the handlebar assembly 17 for steering of the steering nozzle 25 in a generally well known manner.

There is disposed in the steering nozzle 25 adjacent its discharge end a flow deflecting device, indicated generally by the reference numeral 31 and which has an inlet end 32 that faces the direction of water flow from the discharge nozzle 27 of the jet propulsion unit 21. An upwardly directed extending portion 33 of the flow directing device discharges a water spray, as indicated generally by the reference numeral 34 in an upward direction so as to provide a signaling device, as aforenoted.

Figure 4:
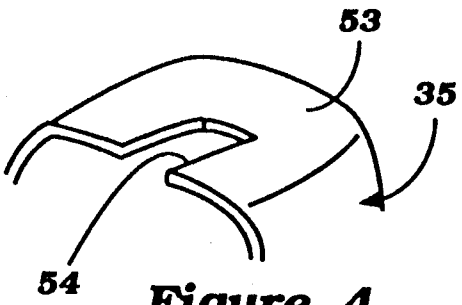
FIG. 4 is a partial perspective view showing the reverse thrust bucket in this embodiment.

In order to permit the watercraft 11 to be operated in a reverse mode, there is provided a flow deflecting reverse bucket assembly, indicated generally by the reference numeral 35 and shown in most detail in FIGS. 2 through 4. The reverse bucket assembly 35 has a central area 36 which is adapted to extend across the discharge end of the steering nozzle 25 and specifically a discharge opening 37 thereof to reverse the direction of thrust, as is well known in this art. The section 36 is connected to a pair of side sections 38 which are journaled on opposite sides of the steering nozzle 25 by pivot bolt assemblies 39.

An operating lever assembly, indicated generally by the reference numeral 41, has a generally inverted U shape and has a pair of side sections 42 that are pivotally supported upon the jet propulsion unit adjacent the discharge nozzle portion 27 by means of a pair of pivot bolts 43. The side sections 42 are joined by a bridging section 44 that has a tang or lug 45 formed integrally thereon which is connected to an actuating cable 46 by means of a connector 47 for pivoting the operating lever 41 between the forward drive position shown in solid lines in FIG. 2 and the reverse thrust position as shown in phantom lines in this figure.

The lever side portions 42 are each formed with generally Z shaped slots 48 that receive respective follower bolts 49 that are affixed to the sides 38 of the reverse thrust bucket 35. A pair of tension springs 51 are interconnected between the follower bolts 49 and pins 52 affixed to opposite sides of the discharge nozzle 27 of the jet propulsion unit 21 for providing an over center locking to hold the reverse thrust bucket 35 in either its forward drive or reverse drive condition.

By applying a rearward force on the control cable 46, the actuating lever 41 will rotate in a clockwise direction and cam the pins 49 and reverse thrust bucket 35 so that the reverse thrust bucket will rotate from the forward drive position to the reverse drive position. As noted, the tension springs 51 go to an over center condition in either position so as to yieldably restrain the reverse thrust bucket in its position.

It should be noted that at the upper end of the flow directing portion 36 and sides 38 of the reverse thrust bucket, there is provided an interconnecting or bridging wall 53. This wall 53 in the reverse thrust position normally would interfere with the flow directing device 31. However, in order to avoid this, the wall 53 is provided with a clearance slot 54 that will permit the flow directing device 31 to continue to send a spray even when operating in the reverse mode. It should be noted that there is provided a further slot 55 at the opposite end of the flow directing portion 36 so as to not interfere with the spray in the forward drive position.

Figure 5:
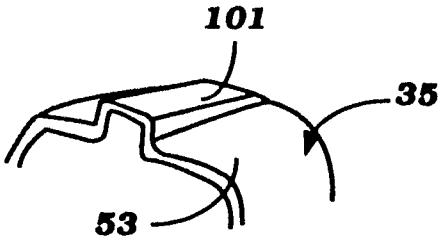
FIG. 5 is a partial perspective view, in part similar to FIG. 4, showing another embodiment of the invention.

In the embodiment of the invention as thus far described, the reverse thrust bucket was provided with a notch so as to permit the flow directing device to continue to spray in both forward and reverse directions and to provide clearance. However, it is not so essential to have such a spray when operating in reverse since this is not a normal state of operation that is maintained for any length of time and usually is not maintained at open sea. Therefore, the upper wall 53 may rather be provided with a raised portion 101 (FIG. 5) so as to provide the necessary clearance to shift into the reverse mode. The raised portion 101 will permit the clearance but will redirect the spray from the device 31 in a forward or concealed direction. As previously noted, this is no major problem.

Figure 6:
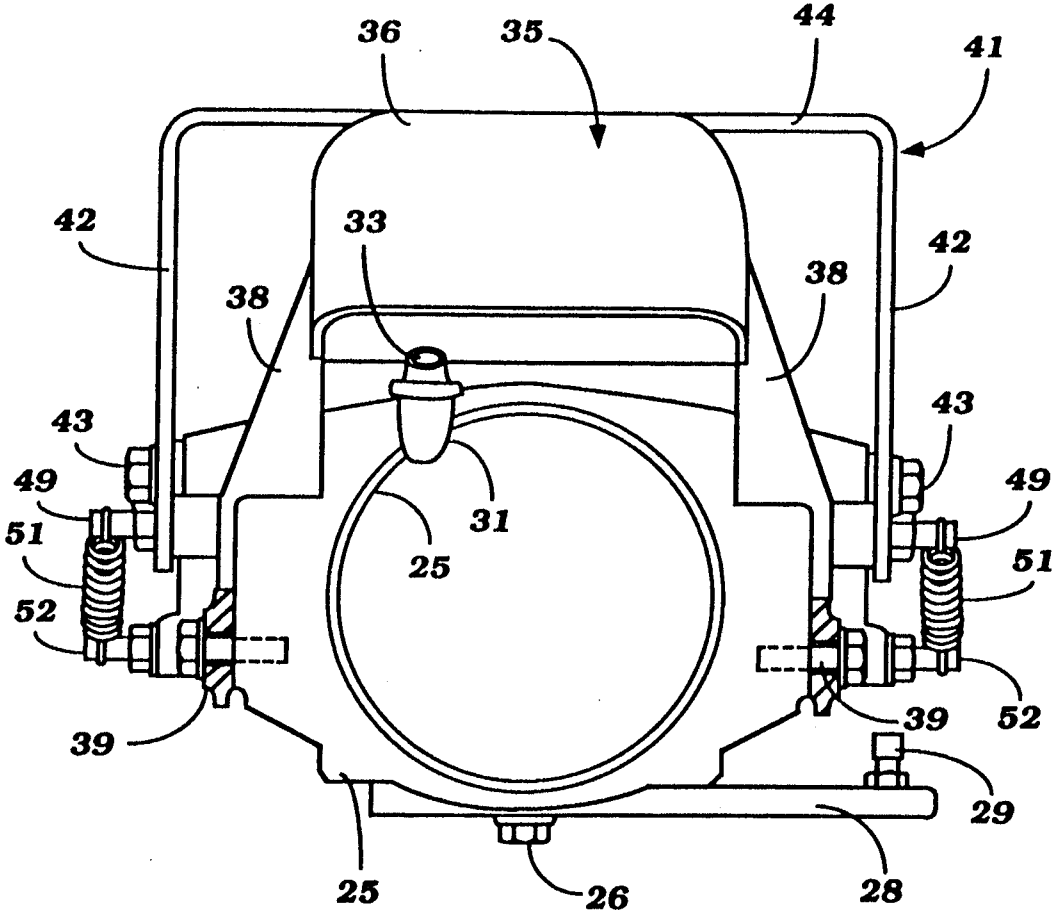
FIG. 6 is a rear elevational view, in part similar to FIG. 3, showing another embodiment of the invention.

In the embodiments of the invention as thus far described, the flow directing device 31 has been positioned so that it is attached directly to an underside 56 of the upper periphery of the steering nozzle 25. As a result, the inlet 32 is in an area where there may be somewhat less water flow than a more central area. As may be seen in FIG. 2, because of the clearance between the steering nozzle 25 and the jet propulsion unit discharge nozzle 27, a portion of the inlet 32 is obstructed and will not receive full water flow. In order to provide a greater spray, the device 31 may be moved to an alternate location to the side and downwardly as shown in FIG. 6 so as to provide this improved result. When this relocation is done, it will not be necessary to provide the relief 55. However, the relief for the device 31 when the reverse bucket assembly 35 is in its reverse position is still required.

It should be readily apparent from the foregoing description that a highly effective jet propulsion unit for a small watercraft has been provided that will permit the use of a reverse thruster without interference with a flow directing spray generating device and also a construction for such a flow generating or deflecting device that is capable of providing better sprays than the prior art construction. The foregoing description is that of preferred embodiments of the invention. Various changes and modifications may be made without departing from the spirit and scope of the invention, as defined by the appended claims.

I claim:

1. A jet propulsion unit for a small watercraft having a discharge nozzle, a flow deflecting device positioned in said discharge nozzle and extending beyond the periphery of said discharge nozzle for deflecting a portion of the water flowing through said discharge nozzle in a generally upward spray to form a rooster tail effect, and a reverse bracket supported for movement from a retracted forward position to an obstructed reverse position wherein said jet propulsion unit effects a reverse thrust, said reverse thrust bucket being formed with a cut away portion to clear said flow directing device when said reverse thrust bucket is in at least one of its positions to permit the generation of said spray when in said one position.

2. A jet propulsion unit for a small watercraft having a discharge nozzle, a flow deflecting device positioned in said discharge nozzle for deflecting a portion of the water flowing through said discharge nozzle in a generally upward spray to form a rooster tail effect, and a reverse bucket supported for movement from a retracted forward position to an obstructed reverse position wherein said jet propulsion unit effects a reverse thrust, said reverse thrust bucket being formed with a clearance portion to clear said flow directing device when said reverse thrust bucket is in at least one of its positions, said clearance portion deflecting the spray when the reverse thrust bucket is in the one position.

3. A jet propulsion unit as set forth in claim 2 wherein the clearance portion is formed by a deformed portion of the reverse thrust bucket.

4. A jet propulsion unit as set forth in claim 2 wherein the flow directing device has its inlet end spaced from the upper periphery of the discharge nozzle.

5. A jet propulsion unit as set forth in claim 4 wherein the flow directing device extends beyond the periphery of the discharge nozzle.

6. A jet propulsion unit as set forth in claim 5 wherein the clearance portion permits the generation of a spray when the reverse thrust bucket is in its one position.

7. A jet propulsion unit as set forth in claim 6 wherein the clearance portion comprises a cutaway in the reverse thrust bucket.

8. A jet propulsion unit as set forth in claim 6 wherein the clearance portion is formed by a deformed portion of the reverse thrust bucket.

9. A jet propulsion unit for a small watercraft having a generally cylindrical discharge nozzle and a flow deflecting device positioned in said discharge nozzle for deflecting a portion of the water flowing through said discharge nozzle in a generally upward direction to form a rooster tail effect, the improvement comprising said flow deflecting device positioned within said discharge nozzle and having an inlet end facing upstream in the discharge nozzle and positioned to one side of a vertically extending plane passing through the center of said discharge nozzle and a discharge end positioned rearwardly of said discharge nozzle and discharging vertically upwardly on one side of said plane for providing said rooster tail effect, all of the water exiting from said discharge end being supplied solely from said inlet end.

* * * * *